US006865908B1

(12) United States Patent
Cheng

(10) Patent No.: US 6,865,908 B1
(45) Date of Patent: Mar. 15, 2005

(54) JEWELRY CONNECTOR

(76) Inventor: Howard S. Cheng, 2821 S. Quinn St., Chicago, IL (US) 60608

( * ) Notice: Subject to any disclaimer, the term of this patent is extended or adjusted under 35 U.S.C. 154(b) by 0 days.

(21) Appl. No.: 10/120,020

(22) Filed: Apr. 10, 2002

(51) Int. Cl.[7] ..... A44C 17/02
(52) U.S. Cl. ..... 63/29.1; 63/21; 63/23
(58) Field of Search ..... 63/21, 23, 29.1; 24/599.2, 598.2, DIG. 35, 574.1, 583.1, 581.12, 582.1; 59/85, 86, 87, 88, 89, 93, 95; 70/457, 459

(56) References Cited

U.S. PATENT DOCUMENTS

| | | | | | |
|---|---|---|---|---|---|
| 770,709 | A | * | 9/1904 | Blue et al. | 59/85 |
| 837,295 | A | * | 12/1906 | Fisher | 70/18 |
| 912,323 | A | | 2/1909 | Pollock | |
| 959,836 | A | * | 5/1910 | Beer | 70/459 |
| 1,454,335 | A | * | 5/1923 | Prendergast | 59/85 |
| 1,642,322 | A | | 9/1927 | Beck et al. | |
| 1,657,924 | A | * | 1/1928 | Gouverneur et al. | 59/85 |
| 1,831,765 | A | * | 11/1931 | Gouverneur | 403/310 |
| 2,292,116 | A | | 8/1942 | Goodwin | |
| 2,321,504 | A | * | 6/1943 | Morse | 70/459 |
| 2,400,424 | A | * | 5/1946 | Levesque | 70/459 |
| 2,620,650 | A | * | 12/1952 | Cotti | 70/459 |
| 2,677,864 | A | * | 5/1954 | Nielsen | 24/599.2 |
| 4,193,258 | A | * | 3/1980 | Fasnacht | 59/86 |
| 4,358,944 | A | * | 11/1982 | Stoffel | 70/457 |
| 5,782,108 | A | | 7/1998 | Cannata et al. | |
| 6,237,367 | B1 | | 5/2001 | Cheng | |

* cited by examiner

*Primary Examiner*—Robert J. Sandy
*Assistant Examiner*—Thomas Ho
(74) *Attorney, Agent, or Firm*—Andrus, Sceales, Starke & Sawall, LLP

(57) ABSTRACT

A closed loop connector for jewelry includes a first U-shaped connector half formed from a flat strip of metal and a second U-shaped connector half formed from a piece of metal wire. The connector half formed form the flat strip of metal includes tubular cylindrical end portions. The second U-shaped connector half is formed from a piece of metal wire having headed end portions, one of the headed end portions being captured in one of the cylindrical end portions and held therein for rotation on the axis thereof. The other of the headed end portions is captured in the other cylindrical end portion by lateral movement through an open slot in response to resilient deflection of the edges of the end portion forming the slot. The metal strips forming one of the U-shaped connector halves may be formed from stampings of different configurations.

7 Claims, 2 Drawing Sheets

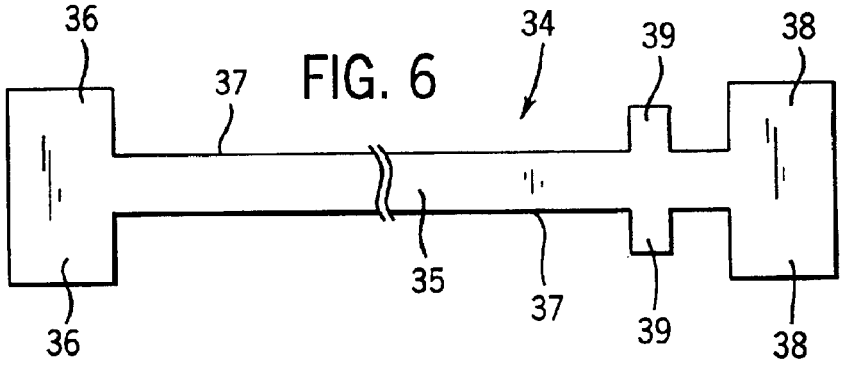
FIG. 6
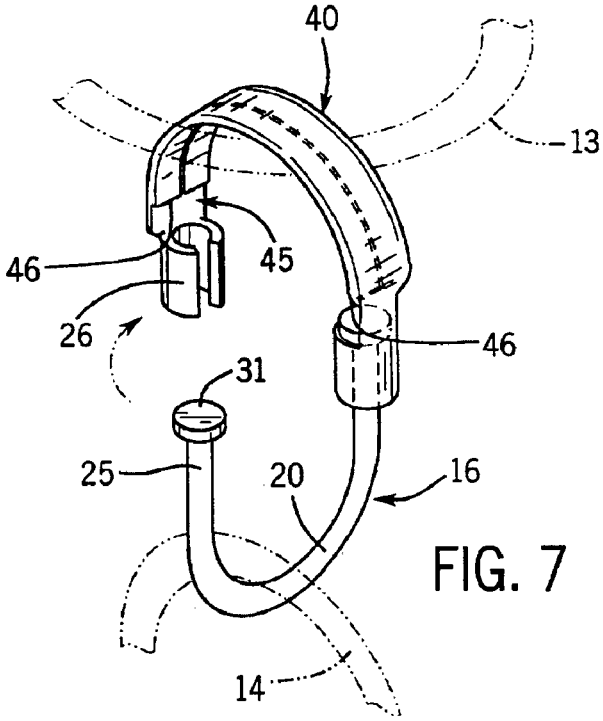
FIG. 7
FIG. 8
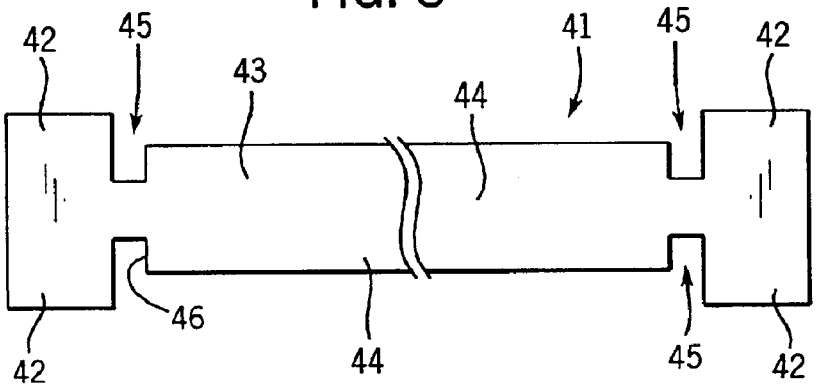

JEWELRY CONNECTOR

BACKGROUND OF THE INVENTION

The present invention pertains to a closed loop connector for jewelry and, more particularly, to a connector for attaching charms, pendants and the like to a bracelet, necklace or similar jewelry item.

Charm bracelets have long been popular jewelry items in which open loop linked bracelets have small decorative items, typically symbolic an event, person, or the like, individually attached to links along the bracelet. Several types of connectors are utilized to attach a charm to a bracelet. One of the simplest connectors is a circular loop to which both the charm and a bracelet link are attached with the ends of the loop soldered to prevent loss. Since a jeweler is typically needed to perform the connection and soldering operation, the process is both expensive and time consuming. It is also known to connect charms to a bracelet with a conventional small split ring. It is well known, however, that the ends of the split ring can catch on threads and other parts of clothing. In addition, small split rings are not readily opened and operated by the ordinary person without the use of a special tool. Special locking connectors are also known, but their construction and operation are often complicated, making them quite expensive. Thus, the attachment of charms to a charm bracelet or necklace must usually be done by a jeweler and at a substantial cost to the owner.

It would be very desirable to have a connector that could be used by the ordinary person to attach a charm to a bracelet in a relatively simple but secure manner.

SUMMARY OF THE INVENTION

In accordance with the present invention, a closed loop jewelry connector, suitable for attaching charms, pendants and the like to a bracelet or necklace, can be operated by an unskilled user to securely make the connection without special tools and in a manner providing a secure connection without soldering.

The connector of the present invention comprises a first U-shaped connector half that is formed from a flat metal strip and has tubular cylindrical end portions on parallel axes, each cylindrical end portion defined by opposite open ends that are interconnected with a longitudinal slot. A second U-shaped connector half is formed from a piece of metal wire and has opposite end portions that are headed. One of the headed end portions is captured in one of the cylindrical end portions of the first connector half and is held therein for rotation on the axis of that cylindrical end portion. The other headed end portion is captured in the other cylindrical end portion and is held therein by lateral movement of that headed end portion through the slot in response to resilient opening deflection of the slot. When closed, the headed end portions engage the respective inner ends of the cylindrical end portions of the first connector half.

In the preferred embodiment, the flat metal strip from which the first U-shaped connector half is formed includes widened ends that are curled to form the tubular cylindrical end portions. The slot in one cylindrical end portion is substantially closed to captured one headed end portion of the second connector half therein for rotation, and the slot in the other cylindrical end portion is opened to define a slot width slightly smaller than the diameter of the metal wire forming the second connector half to permit the resilient deflection thereof.

In a presently preferred embodiment, the first connector half includes an abutment edge that comprises a lateral extension of the strip adjacent one of the headed end portions to capture and prevent axial movement thereof in the respective cylindrical end portion. Preferably, the abutment edge is positioned so that, with the inner end of the cylindrical end portion, it defines a slot for the headed end of said headed end portion. The abutment edge may comprise a generally tubular projection that is formed from a pair of tabs extending laterally from opposite side edges of the strip. In a similar manner, each of the cylindrical end portions of the first connector half may be formed from a pair of tabs extending laterally from opposite side edges at one end of the strip.

BRIEF DESCRIPTION OF THE DRAWINGS

FIG. 6 is a plan view of a stamping from which half of the FIG. 2 connector is formed.

FIG. 7 is a perspective view of another embodiment of the connector.

FIG. 8 is a plan view of a stamping from which half of the FIG. 7 connector is formed.

DETAILED DESCRIPTION OF THE PREFERRED EMBODIMENT

Figure 1:
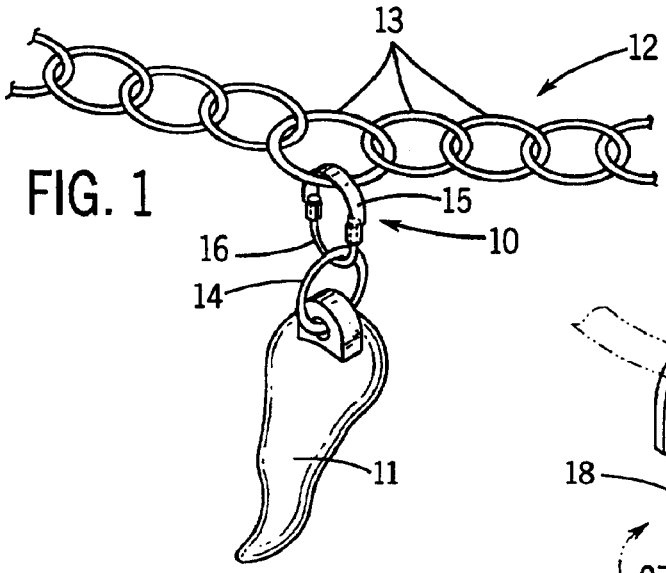
FIG. 1 shows a connector of the subject invention used to attach a charm to the link of a bracelet.

In FIG. 1, a connector 10 of the present invention is shown in one primary intended use to attach a charm 11 to a bracelet 12 comprising a chain of interconnected links 13. As shown, the connector 10 interconnects a loop 14 on the charm with one of the links 13.

The connector 10 is of a two piece construction, including a first U-shaped end and interconnecting second U-shaped half 16. The first U-shaped half 15 is formed from a flat metal strip 17 (see FIG. 6) of a gold alloy or other suitable jewelry metal. The strip is formed with tubular cylindrical end portions 18 on each end and the strip is formed into the U-shape shown. The second U-shaped half 16 is formed from a piece of metal wire 20, also preferably made of a gold alloy or other suitable jewelry metal. The ends of the metal wire piece 20 are formed with heads 21 that are preferably somewhat flattened as shown.

One end of the wire connector half 16 is captured in a closed tubular end portion 22 of the first connector half 15. The closed tubular end portion 22 has opposite outer and inner ends 23 and 24 connected by a closed slot 29 and the head 21 of the wire piece 20 rests on the inner end 24 permitting the U-shaped wire half 16 to pivot between an open position shown in FIG. 2 to a closed and locked position shown in FIG. 4.

Figure 2:
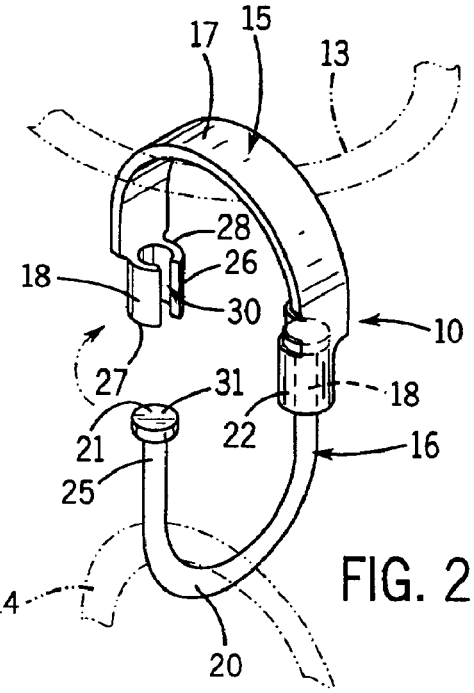
FIG. 2 is an enlarged perspective view of the connector shown in FIG. 1 in an open position.
Figure 5:
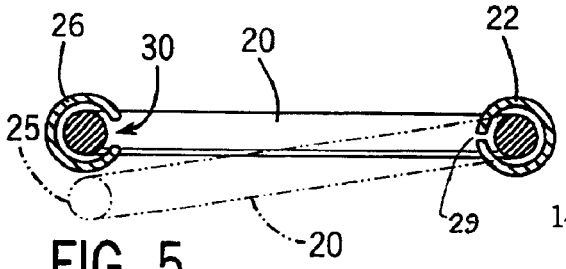
FIG. 5 is an enlarged sectional view taken on line 5—5 of FIG. 4.
Figure 3:
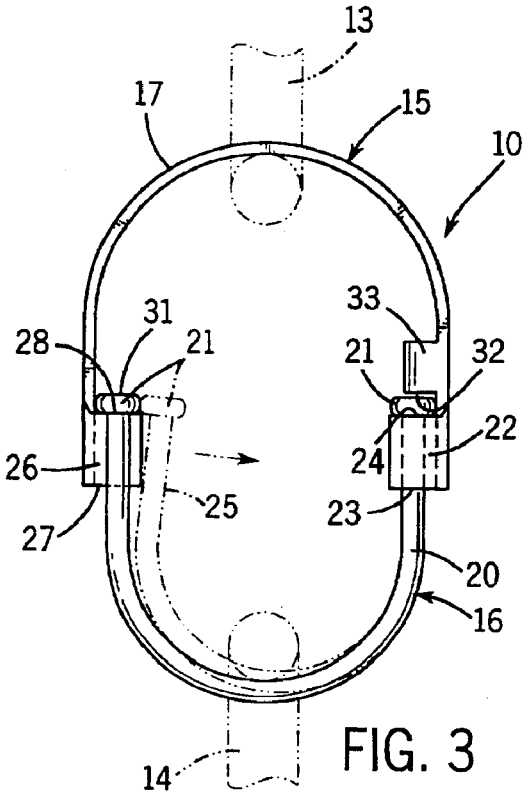
FIG. 3 is an elevation view of the connector showing its closing movement.

In FIG. 2, a bracelet link 13 and the loop 14 of the charm are placed within the open connector 10. The wire piece 20 is then pivoted in the direction of the arrow to bring the free headed end 25 of the U-shaped wire half 16 into engagement with the outer surface of an open tubular end portion 26 on the other end of the first U-shaped connector half 15, as best seen in FIGS. 3 and 5. The open tubular end portion 26 has outer and inner ends 27 and 28, similar to the closed tubular end portion 22 on the other end. However, the open tubular end portion 26 is provided with an open longitudinal slot 30 that interconnects the opposite ends 27 and 28. The slot 30 has a width slightly smaller than the diameter of the metal wire piece 20. When the free end 25 of the wire piece engages the outer surface of tubular end portion 26, finger pressure by the user causes the wire to deflect inwardly over the cylindrical surface, as shown in phantom in FIG. 3, and when the wire is aligned with the open slot 30, a slight outward finger pressure (in the direction of the solid arrow in FIG. 4) causes the headed end 25 of the wire piece to pass through the slot and snap into the tubular bore in the end portion 26. As with the opposite hinged end, the head 31 rests on the inner end 28 of the tubular end portion 26 to prevent axial withdrawal of the U-shaped wire half 16 from the U-shaped strip half 15. The connection is very secure and can be reopened only with considerable difficulty.

The U-shaped wire half 16 of the connector 10 may be made of a wire as small in diameter as 0.020–0.030 inch (0.50–0.75 mm). The open slot 30 in the tubular end portion 26 has a width slightly smaller than the diameter of the wire. It has been found that when the headed end 25 of the metal wire piece 20 snaps into the tubular end portion 26, it remains held securely therein and is not subject to inadvertent or accidental opening. Nevertheless, the connection may be made by the ordinary user with little difficulty and without the use of any tools.

Figure 4:
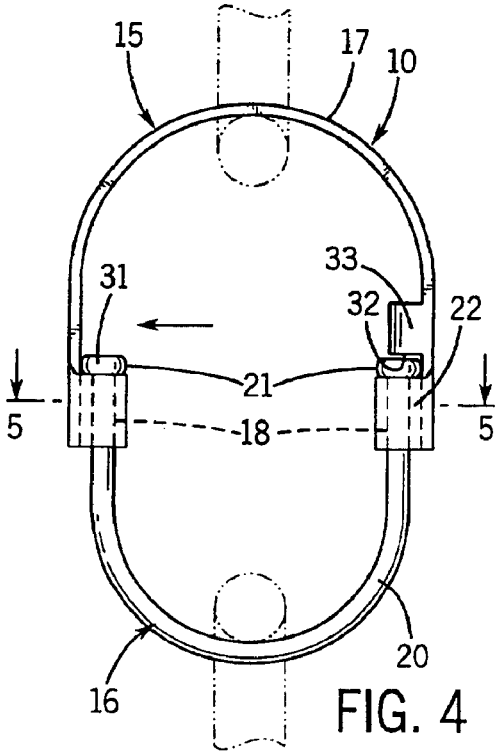
FIG. 4 is an elevation view similar to FIG. 3 showing the connector in the closed position.

It may be desirable to also provide a stop to prevent axial movement of the U-shaped wire half 16 in the tubular end portions 22 and 26 in the direction of the headed ends (i.e. upwardly as viewed in FIG. 4). An abutment edge 32 is provided on a small metal tab 33 formed as an integral lateral extension of the metal strip 17. The abutment edge 32 is positioned just above the head 21 on the closed tubular end portion 22 of the connector. The abutment edge 32 prevents upward axial movement of the U-shaped wire half 16.

In FIG. 6, there is shown a metal stamping 34 of one embodiment of the flat metal strip 17 from which the U-shaped connector half 15 is formed. The stamping includes a long narrow body 35 having a pair of wide tabs 36 extending laterally from the side edge 37 of the body at one end. On the opposite end of the strip, there is another laterally extending pair of wide tabs 38 and, spaced slightly therefrom in the direction of the opposite end, is a pair of somewhat narrower tabs 40, also extending laterally from the body 35 of the strip.

The single pair of wide tabs 36 are curled to form the open tubular end portion 26 of the U-shaped flat 15 of the connector, while the other pair of wide tabs 38 are curled to form the closed tubular end portion 22 on the other end of the connector half 15. The pair of narrower tabs 40 is also curled, but may alternately be simply bent inwardly, to provide the abutment edge 32 to prevent inadvertent axial movement of the wire piece.

In FIG. 8, there is shown an alternate embodiment of a stamping 41 used to make the modified U-shaped half 40 of the connector shown in FIG. 7. This stamping includes the same pairs of wide tabs 42 extending laterally from opposite ends of the stamping, as the stamping 34 of the previously described embodiment. The body 43 of the stamping, however, includes a pair of oppositely extending long edge tabs 44 which terminate at their respective ends to form small gaps 45 with the wide tabs 42. The wide tabs 42 are curled as described with the previous embodiment to form the respective tubular end portions 22 and 26. The long edge tabs 44 are folded over against the body 43 of the stamping and the opposite ends thereof provide abutment edges 46 for the heads 21 of the U-shaped wire half 16 of the connector to prevent axial movement. The folded long edge tabs 44 also serve to strengthen the U-shaped piece 15.

Both of the stampings 34 and 41 shown respectively in FIGS. 6 and 8 may be formed from a continuous strip and fed into progressive tooling to be cut, rolled, folded and curled into its final shape on an automated or semi-automated basis. Also, U-shaped connector halves similar to either the half 15 or the half 40 may be made from stampings of other configurations and shapes. For example, the tubular cylindrical end portions could be made from single elongated tabs instead of a pair of oppositely extending tabs. Other configurations will be obvious to those skilled in the art.

I claim:

1. A two-piece closed loop connector for jewelry comprising:

a first U-shaped connector half formed from a flat strip of malleable and resilient metal and having tubular cylindrical end portions with parallel axes formed from portions of the flat strip, each cylindrical end portion defined by opposite open ends connected by a longitudinal slot;

a second U-shaped connector half formed from a piece of resilient metal wire of a given diameter and having enlarged headed end portions defining heads larger than said diameter, one of said headed end portions captured in one cylindrical end portion and held therein against axial movement for rotation on the axis of said one cylindrical end portion, and the other of said headed end portions captured in the other cylindrical end portion and held therein by initial resilient deflection of said other headed end portion in one lateral direction over the outer surface of said other cylindrical end portion and lateral movement of said other headed end portion in the opposite direction through the slot in response to resilient deflection of said other cylindrical end portion; and, said headed end portions of the second connector half engaging respective inner open ends of the cylindrical end portions of the first connector half.

2. The connector as set forth in claim 1 wherein said flat metal strip includes widened ends that are curled to form said tubular cylindrical end portions.

3. The connector as set forth in claim 2 wherein the slot in said one cylindrical end portion is substantially closed and the slot in said other cylindrical end portion is open to define a slot width slightly smaller than the diameter of the metal wire forming the second connector half.

4. The connector as set forth in claim 1 including an abutment edge comprising a lateral extension of said strip adjacent one of said headed end portions to prevent axial movement thereof in the respective cylindrical end portion.

5. The connector as set forth in claim 4 wherein said abutment edge is positioned to define with an adjacent end of the cylindrical end portion a slot for the head of the headed end portion.

6. The connector as set forth in claim 4 wherein said abutment edge comprises a generally tubular projection formed from a pair of tabs extending laterally from opposite edges of the strip.

7. The connector as set forth in claim 1 wherein each of said cylindrical portions is formed from a pair of tabs extending laterally from opposite edges at an end strip.

* * * * *